US012465105B2

(12) United States Patent
Rodgers

(10) Patent No.: US 12,465,105 B2
(45) Date of Patent: Nov. 11, 2025

(54) BASEBALL CAP

(71) Applicant: THNK, INC., Lubbock, TX (US)

(72) Inventor: Trafton D. Rodgers, Lubbock, TX (US)

( * ) Notice: Subject to any disclaimer, the term of this patent is extended or adjusted under 35 U.S.C. 154(b) by 0 days.

(21) Appl. No.: 18/620,328

(22) Filed: Mar. 28, 2024

(65) Prior Publication Data

US 2024/0237774 A1 Jul. 18, 2024

Related U.S. Application Data

(62) Division of application No. 17/047,541, filed as application No. PCT/US2019/029114 on Apr. 25, 2019, now Pat. No. 11,963,569.

(60) Provisional application No. 62/663,685, filed on Apr. 27, 2018.

(51) Int. Cl.

| | |
|---|---|
| ***A42B 1/22*** | (2006.01) |
| ***A42B 1/008*** | (2021.01) |
| ***A42B 1/0182*** | (2021.01) |
| ***A42B 1/0184*** | (2021.01) |
| ***A42B 3/28*** | (2006.01) |
| ***A42C 5/04*** | (2006.01) |

(52) U.S. Cl.

CPC ..... *A42B 1/008* (2013.01); *A42B 1/0182* (2021.01); *A42B 1/0184* (2021.01); *A42B 1/22* (2013.01); *A42B 1/225* (2013.01); *A42B 3/281* (2013.01); *A42B 3/285* (2013.01); *A42B 3/286* (2013.01); *A42C 5/04* (2013.01)

(58) Field of Classification Search

CPC ..... A42B 1/22; A42B 1/225

See application file for complete search history.

(56) References Cited

U.S. PATENT DOCUMENTS

| | | | | | |
|---|---|---|---|---|---|
| 1,513,682 | A | * | 10/1924 | Weinstein | A42B 1/22 24/311 |
| RE17,064 | E | * | 8/1928 | Fischer | A42B 1/22 2/173.5 |
| 1,684,610 | A | * | 9/1928 | Weir | A42B 1/22 2/181 |
| 2,185,306 | A | * | 1/1940 | Marks | A42B 1/22 2/209.3 |
| 2,325,473 | A | * | 7/1943 | Brill | A42B 1/22 132/59 |

(Continued)

OTHER PUBLICATIONS

Mar. 30, 2020 International Search Report issued in International Patent Application No. PCT/US2019/029114.

(Continued)

*Primary Examiner* — Khaled Annis

(74) *Attorney, Agent, or Firm* — Williams Mullen; R. Brian Drozd

(57) ABSTRACT

Baseball caps to be worn on a person's head are provided. According to one embodiment, a baseball cap includes a strap assembly configured to adjust a tightness of the dome on the wearer's head, the strap assembly including an outer strap attached to a first edge portion of the dome and an inner strap attached to a second edge portion of the dome. The inner strap is configured to be movable within the outer strap, and the first cable is configured to draw the inner strap closer to the first edge portion of the dome and the second cable is configured to draw the outer strap closer to the second edge portion of the dome.

20 Claims, 19 Drawing Sheets

(56) References Cited

U.S. PATENT DOCUMENTS

| | | | | |
|---|---|---|---|---|
| 2,624,052 | A * | 1/1953 | Redlin | A42B 1/22 2/204 |
| 2,797,417 | A * | 7/1957 | Goldman | A42B 1/22 2/195.4 |
| 4,709,702 | A | 12/1987 | Sherwin | |
| 5,471,684 | A | 12/1995 | Casale | |
| 5,533,211 | A | 7/1996 | Mehrens | |
| 5,581,808 | A | 12/1996 | Garza | |
| 5,613,246 | A | 3/1997 | Alexander | |
| 5,715,534 | A | 2/1998 | Mobley | |
| 5,870,772 | A | 2/1999 | Sprouse | |
| 6,050,099 | A | 4/2000 | Lopa et al. | |
| 6,151,718 | A | 11/2000 | Shirai | |
| 6,263,508 | B1 | 7/2001 | Davis | |
| 6,446,266 | B1 * | 9/2002 | Park | A42B 1/248 2/175.1 |
| 6,453,475 | B1 * | 9/2002 | Johnson | A42B 1/22 2/209.12 |
| 6,467,096 | B1 * | 10/2002 | Coluccio | A42B 1/22 2/195.2 |
| 6,598,236 | B1 | 7/2003 | Gantt | |
| 6,789,267 | B2 | 9/2004 | Ahn | |
| 6,941,581 | B1 * | 9/2005 | England | A42B 1/22 2/195.2 |
| 7,240,373 | B2 | 7/2007 | Ahn et al. | |
| 8,136,169 | B2 | 3/2012 | Taylor | |
| 10,201,212 | B2 * | 2/2019 | Beers | A43C 11/14 |
| 10,362,825 | B2 | 7/2019 | Judge | |
| 10,932,512 | B2 * | 3/2021 | Lacy | A42B 1/22 |
| 11,547,159 | B2 * | 1/2023 | Powell | A42B 1/22 |
| 11,666,110 | B1 * | 6/2023 | Panzer | A42B 1/041 2/183 |
| 2004/0040067 | A1 | 3/2004 | Pong | |
| 2004/0187191 | A1 * | 9/2004 | Lee | A42B 1/22 2/171 |
| 2007/0017003 | A1 | 1/2007 | Harris et al. | |
| 2008/0163406 | A1 | 7/2008 | Solari | |
| 2009/0032049 | A1 | 2/2009 | Rabin et al. | |
| 2013/0152274 | A1 | 6/2013 | Welch | |
| 2014/0101821 | A1 * | 4/2014 | Dammann | A42B 1/12 2/171.4 |
| 2015/0296916 | A1 | 10/2015 | Olivera, II | |
| 2016/0037833 | A1 | 2/2016 | Kriesel | |
| 2016/0255895 | A1 * | 9/2016 | Shedd | A42B 1/22 |
| 2017/0035134 | A1 | 2/2017 | Olivera, II | |
| 2017/0318886 | A1 * | 11/2017 | Quiroz | A42B 1/24 |
| 2018/0064199 | A1 | 3/2018 | Battis et al. | |
| 2019/0142095 | A1 | 5/2019 | Judge | |
| 2020/0029650 | A1 * | 1/2020 | Dyer | A43B 13/125 |
| 2020/0297057 | A1 | 9/2020 | Davis et al. | |
| 2021/0112901 | A1 * | 4/2021 | Rodgers | A42B 3/286 |
| 2022/0330643 | A1 * | 10/2022 | New | A41D 20/00 |

OTHER PUBLICATIONS

Oct. 27, 2020 International Preliminary Report on Patentability issued in International Patent Application No. PCT/US2019/029114.

Nov. 24, 2021 Office Action issued in Canadian Patent Application No. 3,097,496.

* cited by examiner

BASEBALL CAP

CROSS-REFERENCE TO RELATED APPLICATION

The present application is a Divisional of U.S. patent application Ser. No. 17/047,541 filed Oct. 14, 2020, which is a National Stage Application of PCT/US2019/029114 filed Apr. 25, 2019, which claims the benefit of U.S. Provisional App. No. 62/663,685, filed Apr. 27, 2018.

BACKGROUND

Baseball caps are generally designed for providing protection to a wearer's head. Particularly, a top part of a baseball cap protects the top of the wearer's head from potentially harmful solar rays, while the brim of the cap is intended to protect the wearer's eyes and face from direct sunlight. In general, baseball caps have seen relatively few changes over the past several decades.

Some accessories have been added to baseball caps, such as those that are intended to provide a cooling effect for the wearer. For example, one such accessory is a fan that is designed to direct airflow to the wearer's head. Another example is a water-cooling apparatus. However, these devices are marginal in their cooling effectiveness, especially in environments of high humidity.

In some environments, a wearer may face the issue regarding the effectiveness of blocking the sun's rays from reaching the wearer's face or neck. Thus, the wearer may turn the cap backward (i.e., catcher's position) or turn the cap to the side to strategically position the brim of the cap to block the sun's rays from a certain direction. One problem with turning the cap in different directions on the top of the wearer's head is that the cap may not fit properly, especially when turned to the side. Also, plastic size-adjustment straps may be pressed against the forehead or side of the head in these alternate positions, causing discomfort for the wearer. In addition, when turned to the side or back, the logo may not be visible to others as it is no longer be oriented facing forward.

Another issue with traditional baseball caps is that the wearer must manually adjust the size of the caps, which may take a bit of time and effort. Also, when the cap is snug and is then taken off of the head, the cap typically messes up the wearer's hair, leaving the wearer with "hat hair."

Therefore, since conventional baseball caps include a number of inherent issues that may be undesirable for many wearers, there is a need to provide improved baseball caps having features that overcome these undesirable issues.

SUMMARY

According to one embodiment, a baseball cap as describe in the present disclosure may include a dome configured to be placed on a wearer's head, wherein the dome comprises one or more panels and one or more cooling channels. The baseball cap may also include a hub positioned at a top of the dome. The hub comprises a central cavity and one or more conduits in gaseous communication with the one or more cooling channels of the dome. In addition, the baseball cap further includes a coolant output port in gaseous communication with the central cavity. The coolant output port is configured to supply a coolant gas to the one or more cooling channels of the dome via the central cavity of the hub.

In another embodiment of the present disclosure, a baseball cap comprises a dome configured to be placed on a wearer's head, the dome including one or more panels and a downward-extending fold. The baseball cap also comprises a brim including an upward-extending fold configured to interlock with the downward-extending fold of the dome. The position of the brim is adjustable with respect to the dome by sliding the upward-extending fold of the brim with respect to the downward-extending fold of the dome.

According to yet another embodiment, a baseball cap includes a dome configured to be placed on a wearer's head and a strap assembly configured to adjust a tightness of the dome on the wearer's head. The strap assembly includes an outer strap attached to a first edge portion of the dome and an inner strap attached to a second edge portion of the dome. The inner strap is configured to be movable within the outer strap. The baseball cap further includes a motor attached to first and second cables. The first cable is configured to draw the inner strap closer to the first edge portion of the dome and the second cable is configured to draw the outer strap closer to the second edge portion of the dome.

In yet another embodiment, a baseball cap comprises a dome and a plurality of brainwave sensors positioned on an inside surface of the dome such that the brainwave sensors are configured to contact a wearer's head when the baseball cap is placed on the wearer's head. The brainwave sensors are configured to be receptive to brainwave activity of the wearer. The baseball cap further comprises a control box in electrical communication with the plurality of brainwave sensors.

DETAILED DESCRIPTION OF EMBODIMENTS

A number of embodiments of baseball caps are provided in the present disclosure to improve upon traditional baseball caps. Some embodiments disclosed herein include baseball caps that are capable of providing a coolant gas to the head of the wearer, which can be a benefit in environments where the cap is being worn in hot and/or humid climates. Some embodiments of baseball caps may include the capability of moving the brim of the cap around the perimeter of the cap to position the brim so as to block the sun's rays in a desirable manner without the necessity of adjusting the entire cap. Still other embodiments include a self-tightening feature of a baseball cap, whereby the cap can sense when the user has placed the cap on his or her head and then automatically tighten the cap to achieve a desired degree of tightness. Yet other embodiments may include a baseball cap having the ability to sense brainwaves of the wearer, which may be helpful in situations where a wearer's mental state may have negative consequences if additional actions are not taken.

It should be understood that these embodiments of baseball caps may be combined together in any combination to include any one or more of the features mentioned herein. For example, according to the teachings of the present disclosure, one baseball cap may include a first feature (e.g., the coolant gas providing feature) along with a second feature (e.g., the self-tightening feature), whereby another baseball cap may include a first feature (e.g., the coolant gas providing feature) with a second feature (e.g., the brim adjusting feature) and a third feature (e.g., the EEG system).

Therefore, the embodiments of baseball caps described in the present disclosure are able to overcome many of the undesirable qualities of regular baseball caps. The baseball caps as taught in the present disclosure include improvements to traditional baseball caps to provide greater comfort and protection from the sun's rays, and in some implementations may further provide a way to detect the brain activity of the wearer.

Figure 1:
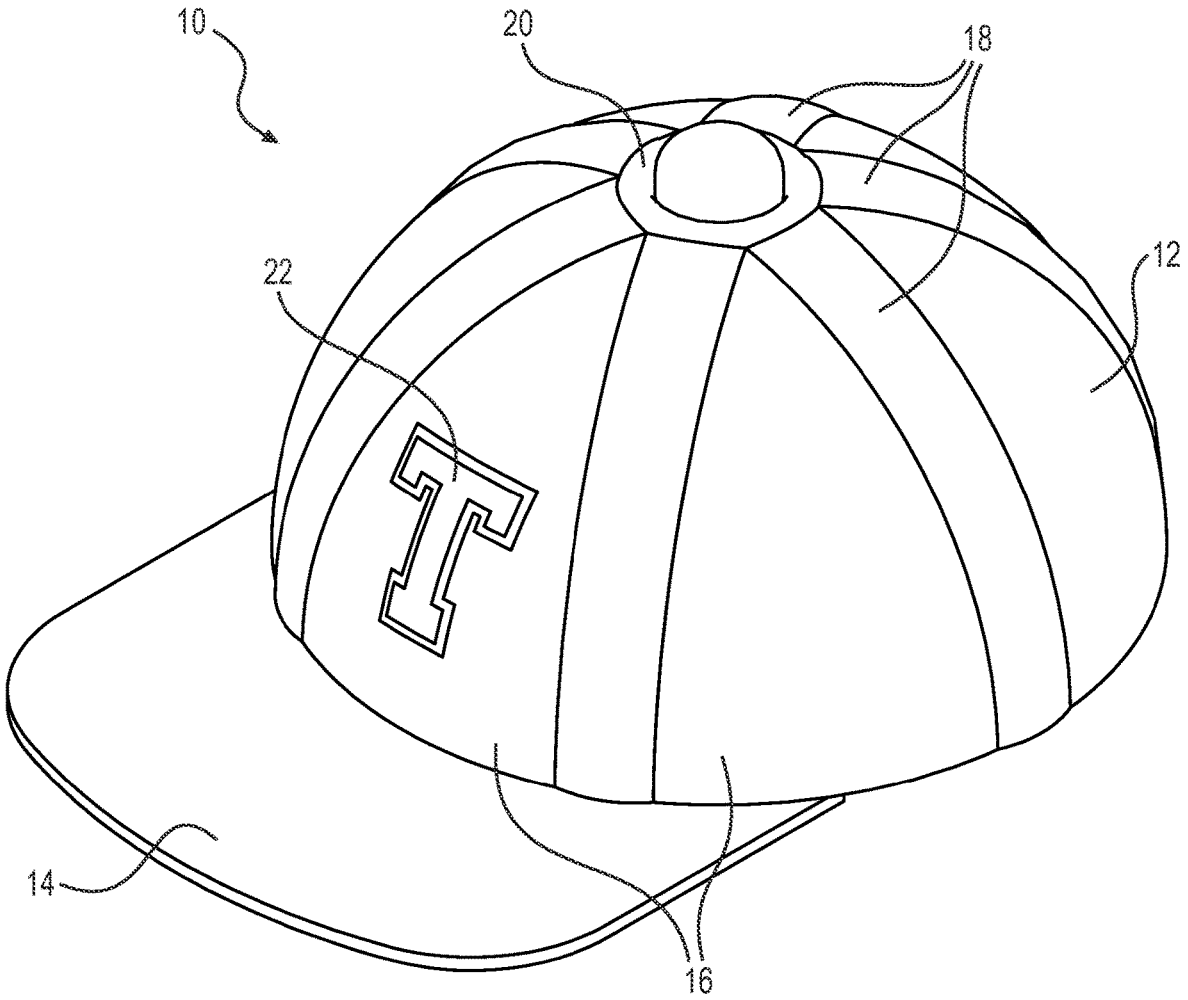
FIG. 1 is a perspective view of a baseball cap according to some embodiments of the present disclosure.

FIG. 1 shows a perspective view of an embodiment of a baseball cap 10. The baseball cap 10, according to various embodiments, includes a dome 12 that is configured to be worn on the wearer's head and a brim 14 or bill that extends out from a bottom edge of the dome 12. The dome 12 may include a plurality of panels 16 and a plurality of cooling channels 18. The panels 16 and cooling channels 18 may be positioned alternately with respect to each other. In some embodiments, the dome 12 may include six panels 16 alternately positioned with respect to six cooling channels 18.

Figure 2:
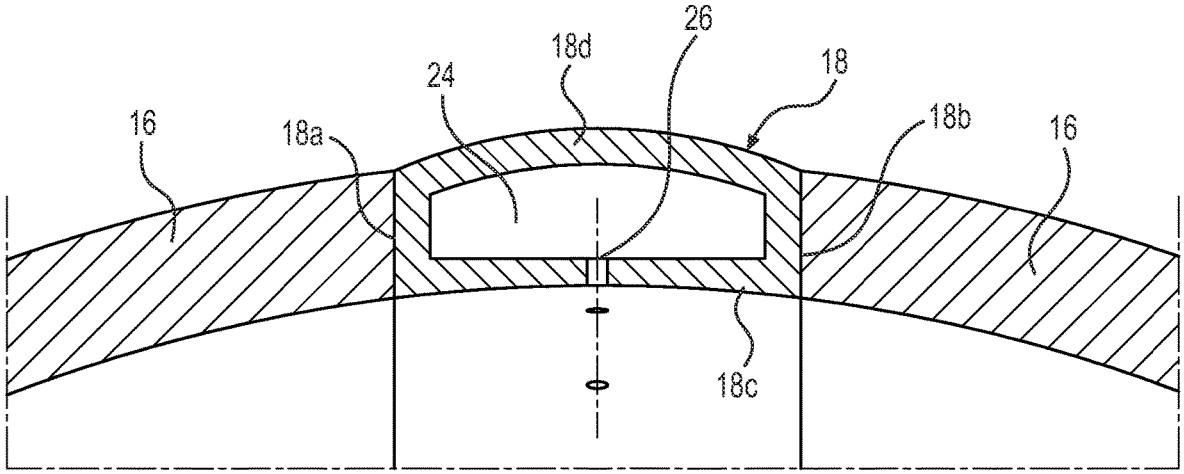
FIG. 2 is a cross-sectional side view of a portion of a dome of the baseball cap of FIG. 1, according to one embodiment.

FIG. 2 illustrates a cross-sectional side view of a portion of the dome 12 of the baseball cap 10. In this figure, portions of two panels 16 are shown separated from each by a cooling channel 18.

The cooling channel 18, according to one embodiment, may include an interior 24 that is defined by an enclosed area configured as a pathway for allowing the flow of a gas, such as coolant gas for cooling the head of the wearer. Walls 18*a*, 18*b*, 18*c*, 18*d* of the cooling channel 18 surround the space of the interior 24.

Side walls 18*a*, 18*b* of the cooling channel 18 may have a height that corresponds substantially with the height of the side walls of the panels 16. Also, an inside wall 18*c* of the cooling channel 18 may provide a continuous curve with respect to the inside walls of the two surrounding panels, thereby providing essentially a seamless surface against the wearer's head.

However, as shown in FIG. 2, a top wall 18*d* of the cooling channel 18 may be curved outward to a greater extent than the curvature of the panels 16. This curved outer surface 18*d* may allow for a larger interior space 24 through which coolant gas may be transferred.

Each of the cooling channels 18 may also include one or more bleeder holes 26. The bleeder holes 26 are openings in the inside wall 18*c* to allow coolant flowing through the cooling channels 18 to escape from the cooling channels 18 for cooling the wearer's head.

Figure 3:
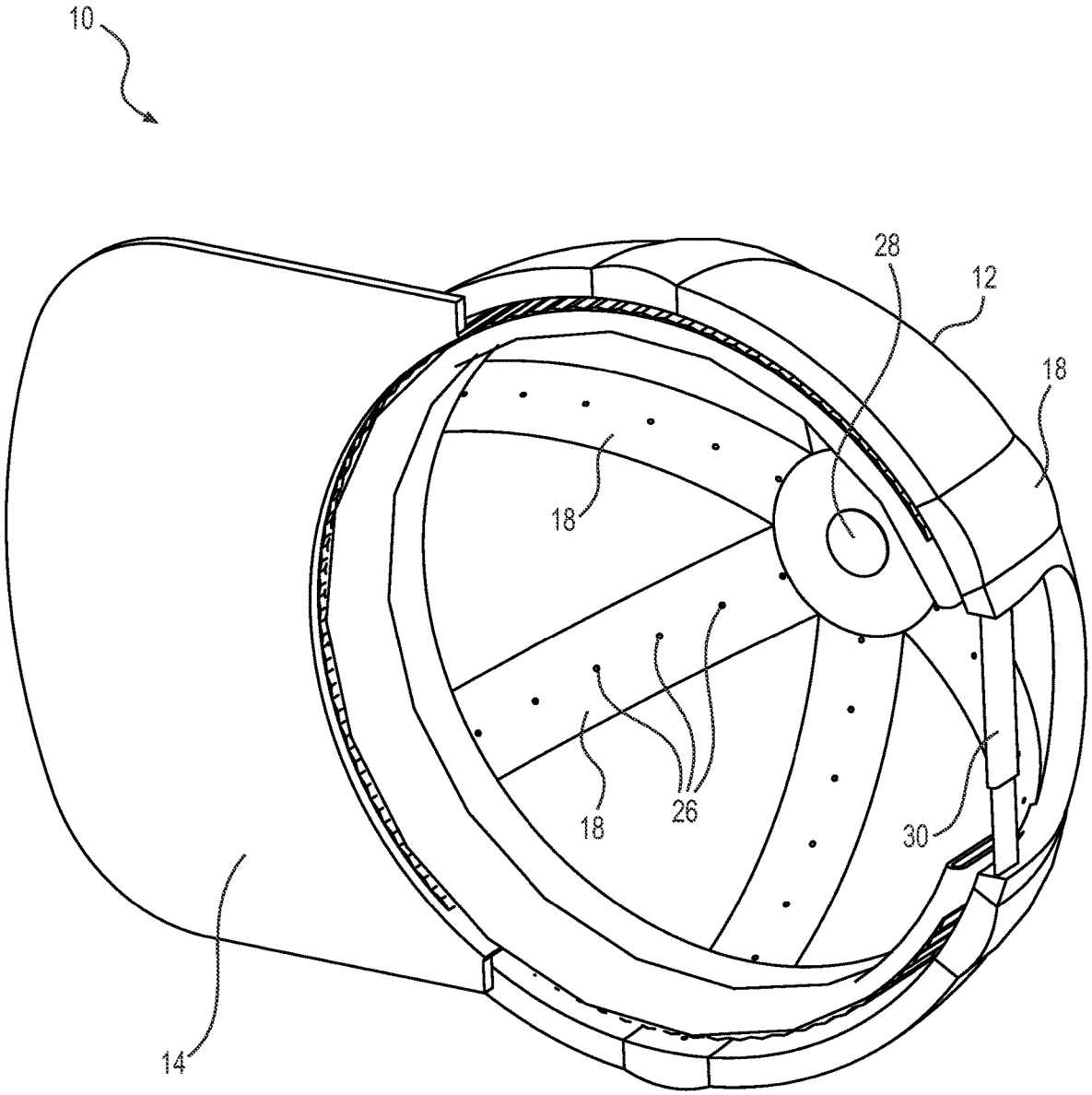
FIG. 3 is perspective view of the baseball cap of FIG. 1 showing an underside of the baseball cap.

FIG. 3 is perspective view showing an underside of the baseball cap 10. As shown, each of the cooling channels 18 includes one or more bleeder holes 26 directed toward an inside of the dome 12, such that coolant escaping from the bleeder holes 26 will be directed to the head of the wearer.

Also shown in FIG. 3 is a proximity sensor 28, which is used to initiate a self-tightening process as described in more detail below. The proximity sensor 28 is positioned on an inside surface of the dome 12, near a top of the dome 12 where the panels 16 and cooling channels merge.

The baseball cap 10 also includes a strap assembly 30 located on the back of the baseball cap 10. The strap assembly 30, defined in more detail below, is used for adjusting the size of a band extending around the bottom edge of the dome 12, whereby the adjustment can be made automatically in accordance with some embodiments.

Figure 4A:
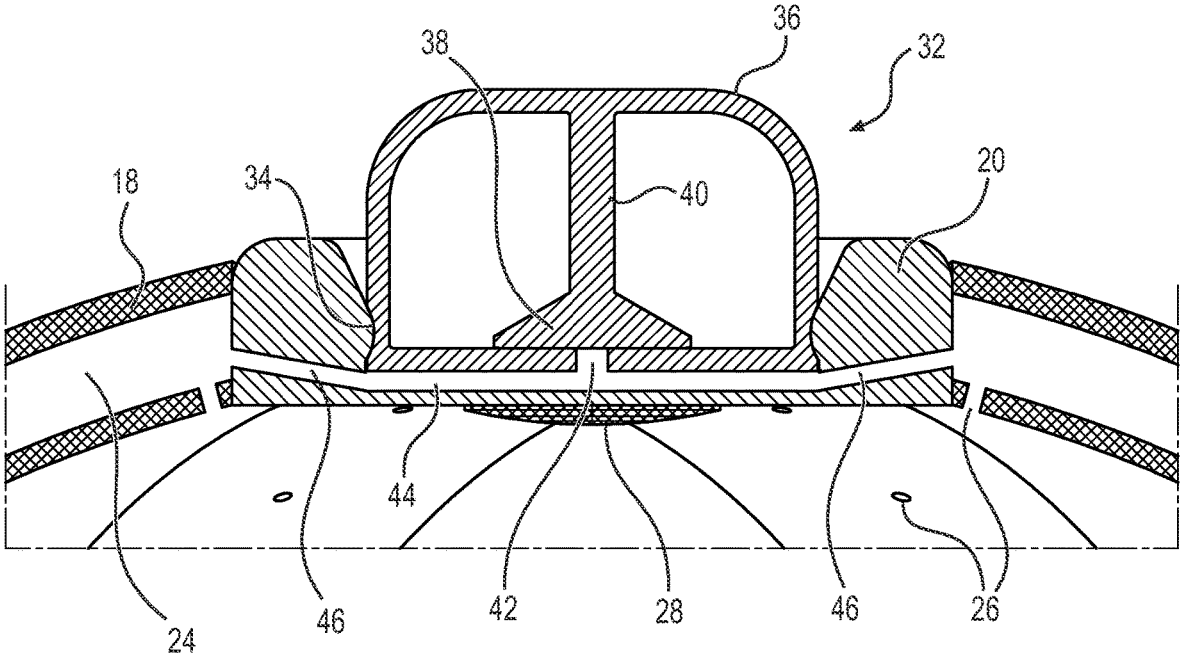
FIG. 4A is a cross-sectional side view of a portion of the dome of the baseball cap of FIG. 1, showing a first cross-section of a coolant container and a hub.
Figure 4B:
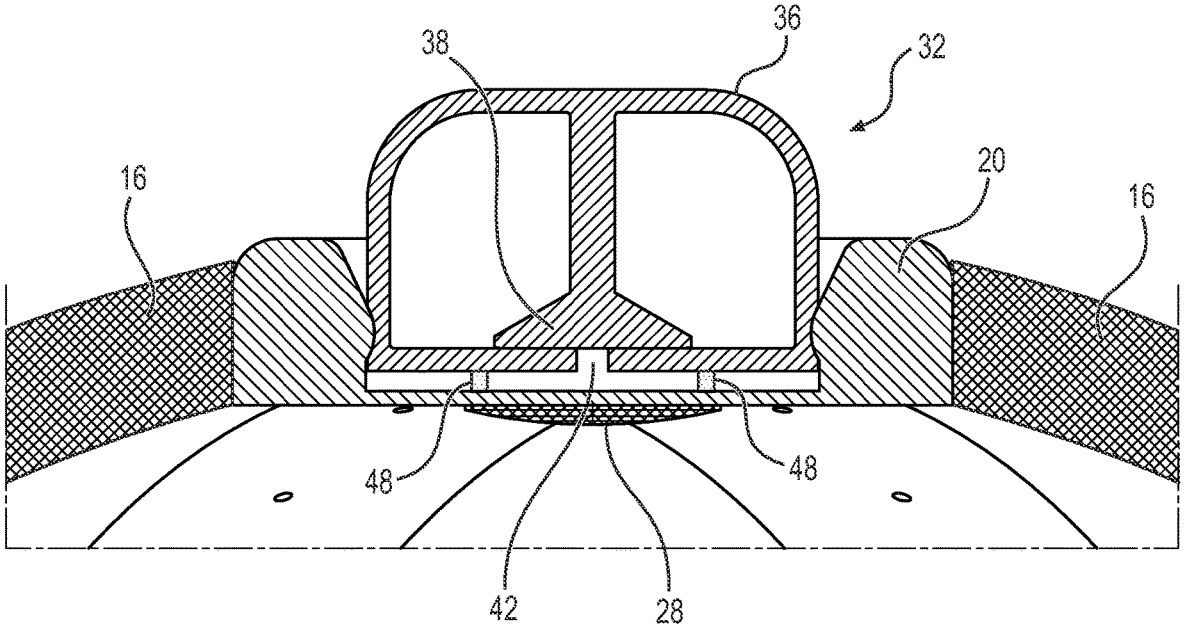
FIG. 4B is a cross-sectional side view of a portion of the dome of the baseball cap of FIG. 1, showing a second cross-section of the coolant container and hub.
Figure 4C:
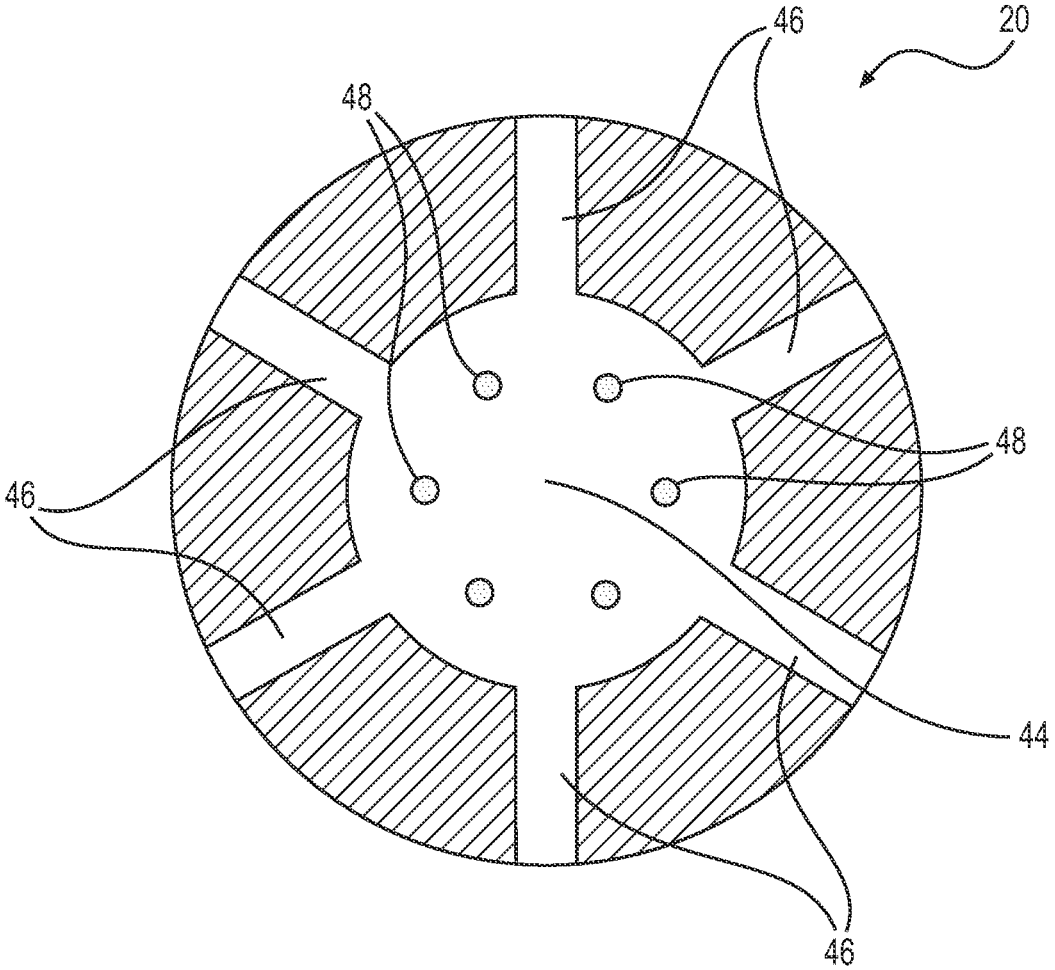
FIG. 4C is a top view of the hub of the baseball cap of FIG. 1, according to one embodiment.

FIG. 4A is a cross-sectional view showing an embodiment of a portion of the dome 12 of the baseball cap 10. FIG. 4A also shows a cross-section of the hub 20, sensor 28, and coolant container 32 at a section where conduits 46 of the hub 20 are located. FIG. 4B is a cross-sectional side view of the portion of the dome 12 shown in FIG. 4A, but from an angle where no conduits of the hub 20 are located. FIG. 4C is a top view of the hub 20 of the baseball cap 10.

The hub 20 includes a reduced diameter portion 34 configured to engage the coolant container 32 when inserted down into a top opening of the hub 20. The reduced diameter portion 34 is configured to apply a pressure on the side walls of the coolant container 32 to hold the coolant container 32 in place.

The hub 20 further includes conduits 46 that branch out from a central cavity 44 of the hub 20. The conduits 46 lead from the central cavity 44 to the channel cavity 24 of each of the cooling channels 18. In the embodiment where the baseball cap 10 includes six cooling channels 18, the hub 20 is configured with six conduits 46 branching from the central cavity 44 to the six channel cavities 24 of the cooling channels 18.

The coolant container 32 includes a coolant reservoir 36, a valve 38, a stem 40, and a coolant output port 42. Coolant is contained within the coolant reservoir 36 until the user wishes to discharge a portion of the coolant from the coolant reservoir 36 to cool the user's head. For example, coolant from the coolant container 32 is allowed to escape from the coolant reservoir 36, through the coolant output port 42 of the coolant container 32, into the central cavity 44 of the hub, through the conduits 46 of the hub 20, through the channel cavities 24 of the cooling channels 18, and finally through the bleeder holes 26 in the cooling channels 18. The coolant fed through the bleeder holes 26 will be directed toward the wearer's head.

According to some embodiments, the baseball cap 10 comprises the dome 12 configured to be placed on a wearer's head. The dome 12 includes one or more panels 16 and one or more cooling channels 18. The hub 20 is positioned at a top of the dome 12 and comprises the central cavity 44 and one or more conduits 46 in gaseous communication with the one or more cooling channels 18 of the dome 12. The coolant output port 42 is also in gaseous communication with the central cavity 44. The coolant output port 42 is configured to supply a coolant gas to the one or more cooling channels 18 of the dome 12 via the central cavity 44 of the hub 20.

Figure 5:
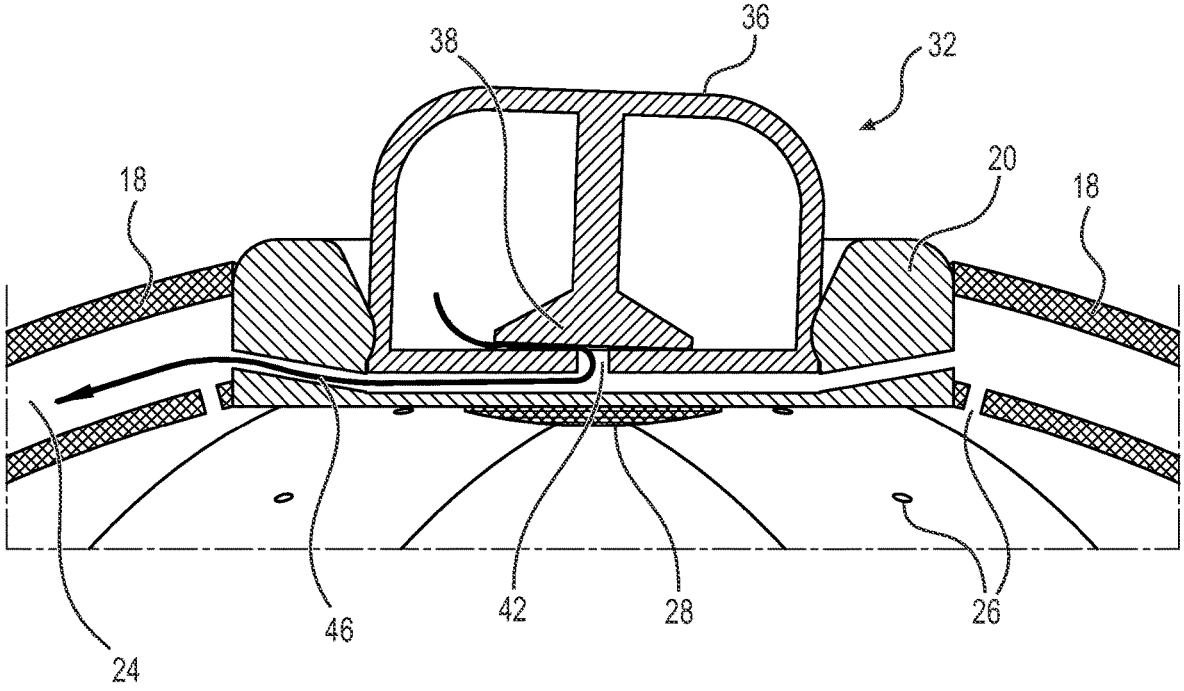
FIG. 5 is a cross-sectional side view of the coolant container shown in FIG. 4A, according to an embodiment of a cooling state.

Furthermore, the baseball cap 10 also comprises the coolant container 32, which includes the coolant reservoir 36 that is configured to store the coolant gas. The coolant container 32 also includes the valve 38 and the coolant output port 42. The valve 38 is configured to separate an interior space of the coolant reservoir 36 from the coolant output port 42 during a non-cooling state and configured to allow coolant to escape from the coolant reservoir 36 through the coolant output port 42 during a cooling state. The valve 38 of the coolant container 32 extends downward from the stem 40 attached to an inside top surface of the coolant reservoir 36 and covers the coolant output port 42 during the non-cooling state. As shown in FIG. 5, when a force is applied to an outside of the coolant container 32 (e.g., in a direction from the left side of the drawing towards the coolant reservoir 36), the stem 40 is tilted with respect to the coolant output port 42 causing the valve 38 to release coolant from the coolant reservoir 36 through the coolant output port 42.

The hub 20 is configured to hold the coolant container 32 such that the coolant output port 42 of the coolant container 32 is adjacent to the central cavity 44 of the hub 20. As shown in FIG. 4B, the hub 20 comprises stand-offs 48 formed on a bottom surface of the central cavity 44 for creating channels between the coolant output port 42 and the one or more conduits 46 of the hub 20 when the coolant container 32 is positioned in the hub 20. The reduced diameter portion 34 of the hub 20 is configured to apply a compression force on exterior side walls of the coolant container 32 to keep the coolant container 32 in a fixed position with respect to the hub 20.

Figure 6:
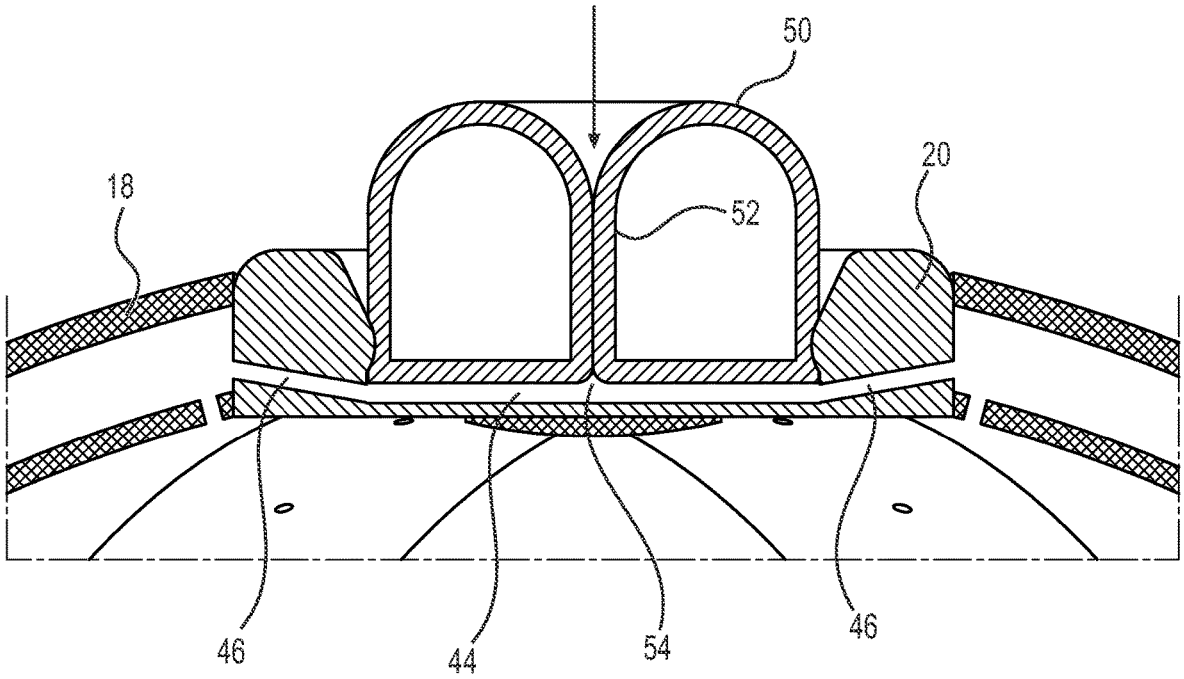
FIG. 6 is a cross-sectional side view of a portion of the dome of the baseball cap of FIG. 1, according to one embodiment.

FIG. 6 is a cross-sectional side view of the portion of the dome 12 at the top of the baseball cap 10. Besides the coolant container 32 described above, other types of elements may be inserted down into the top opening of the hub 20. For example, an injection insert 50 is shown in FIG. 6 in which the injection insert 50 includes an inflation valve 52 and a coolant output port 54. In this embodiment, coolant gas may be supplied by an external source through a needle that is inserted in the inflation valve 52 of the injection insert 50. The needle is inserted through the inflation valve 52 such that the needle extends through the coolant output port 54 into a portion of the central cavity 44 of the hub 20. Coolant from the external source is fed through the needle which directly outputs the coolant into the central cavity 44, which leads through the conduits 46 into the channel cavities 24 of the cooling channels 18 and eventually leads through the bleeder holes 26 to cool the wearer's head.

According to some embodiments, the baseball cap 10 may include other supplemental features in addition to the cooling features discussed above. For instance, the baseball cap 10 may further comprise an adjustable brim. The adjustable brim may include an upward-extending fold, wherein the upward-extending fold interlocks with a downward-extending fold of the dome 12.

Another supplemental feature of the baseball cap 10 is a strap assembly configured to adjust a tightness of the dome 12 on the wearer's head. The strap assembly may include an outer strap attached to a first edge portion of the dome and an inner strap attached to a second edge portion of the dome. The inner strap may be configured to be movable within the outer strap. Also, a motor may be attached to first and second cables, such that the first cable may be configured to draw the inner strap closer to the first edge portion of the dome and the second cable may be configured to draw the outer strap closer to the second edge portion of the dome.

In yet another supplemental feature, the baseball cap 10 may further be equipped with a plurality of brainwave sensors positioned on an inside surface of the dome 12. The brainwave sensors may be configured to contact the wearer's head when the baseball cap 10 is placed on the wearer's head. The brainwave sensors may be configured to be receptive to brainwave activity of the wearer. This embodiment may be used during a baseball game to evaluate the mental state of a pitcher, whereby this information may be used by a manager to determine whether or not the pitcher has enough mental focus to continue pitching in the game.

Figure 7:
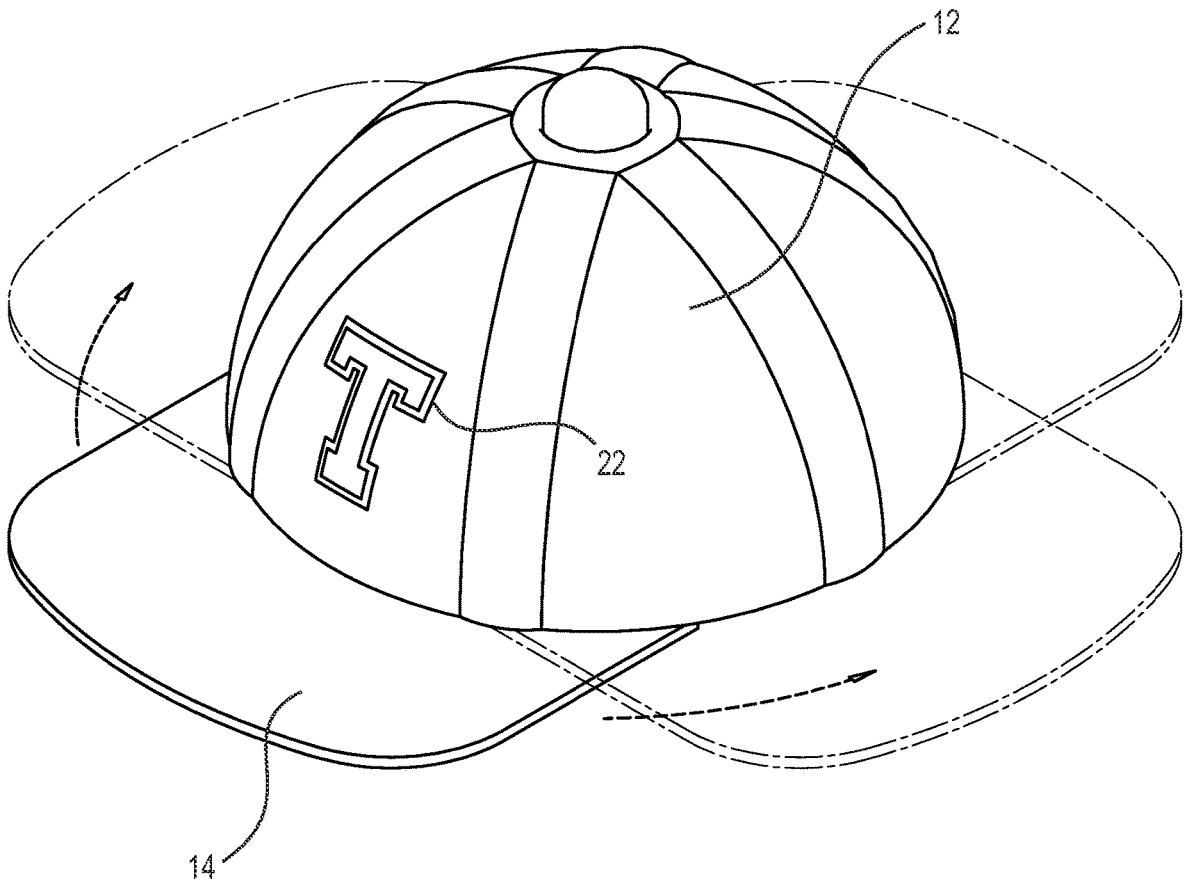
FIG. 7 is a perspective view of a baseball cap, such as the baseball cap of FIG. 1, showing a brim adjustment feature, according to some embodiments of the present disclosure.

FIG. 7 is a perspective view of a baseball cap, such as the baseball cap 10 described above, having additional features for allowing the brim 14 of the cap 10 to be adjusted. In some embodiments, the brim 14 may be adjusted at any angle with respect to the dome 12. As such, the baseball cap 10 can be worn with the logo 22 facing forward, while the brim 14 can be adjust at different angles with the logo 22 still oriented in a forward direction. According to other embodiments, the brim 14 may be adjustable at various angles less than 360 degrees around the dome 12.

Figure 8:
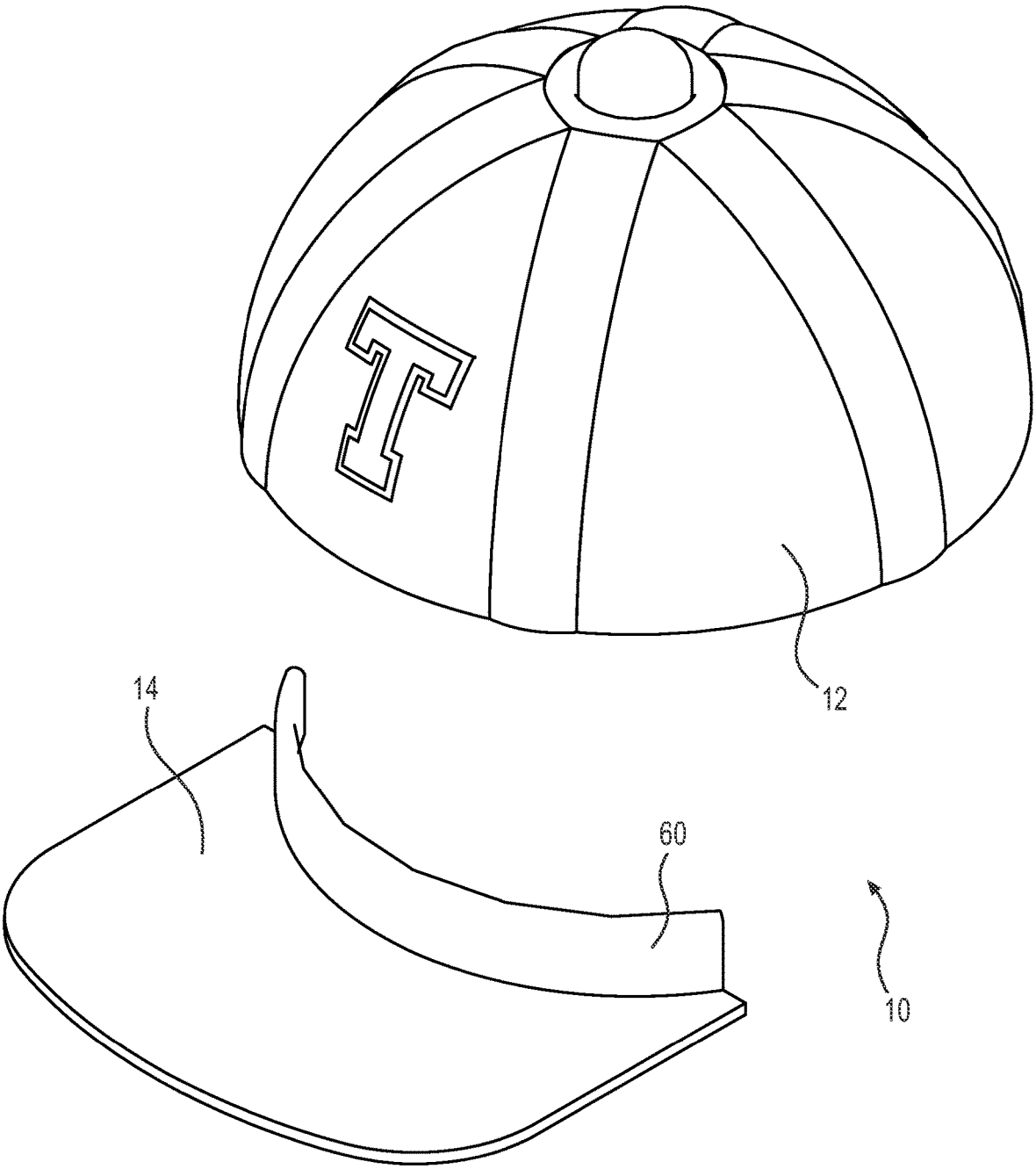
FIG. 8 is a perspective front side view of the baseball cap of FIG. 7 with the dome and brim separated.

FIG. 8 is a perspective front side view showing an embodiment of the baseball cap 10 of FIG. 7 allowing the brim 14 to be adjusted, wherein the dome 12 and brim 14 are shown as separate pieces. In this embodiment, the brim 14 includes an upward-extending fold 60, which is configured to engage a similar fold in the dome 12.

Figure 9:
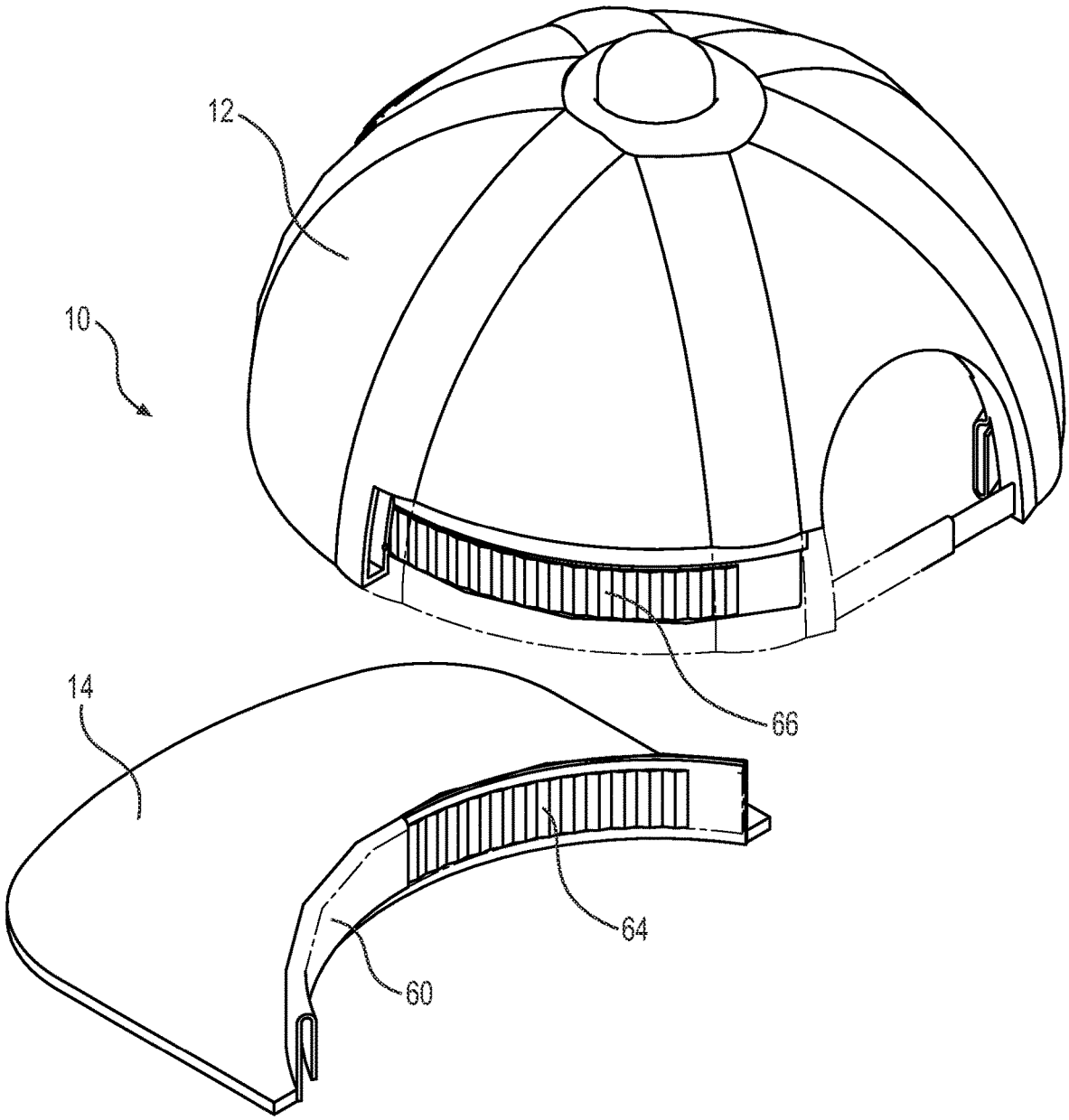
FIG. 9 is a perspective back side view of the baseball cap of FIG. 7 with the dome and brim separated.

FIG. 9 is a perspective back side view of the embodiment of the brim adjusting features of the baseball cap 10, again with the dome 12 and brim 14 separated. A rear-facing side of the upward-extending fold 60 includes a number of ridges 64, which are configured to engage corresponding ridges 66 on outer-facing sides of a fold of the dome 12. The ridges 64, 66 engage each other to provide resistance such that the brim 14 is held somewhat stable, unless the user applies oppositely directed forces to the dome 12 and brim 14 to move the brim 14 at different angles with respect to the dome 12.

Figure 10:
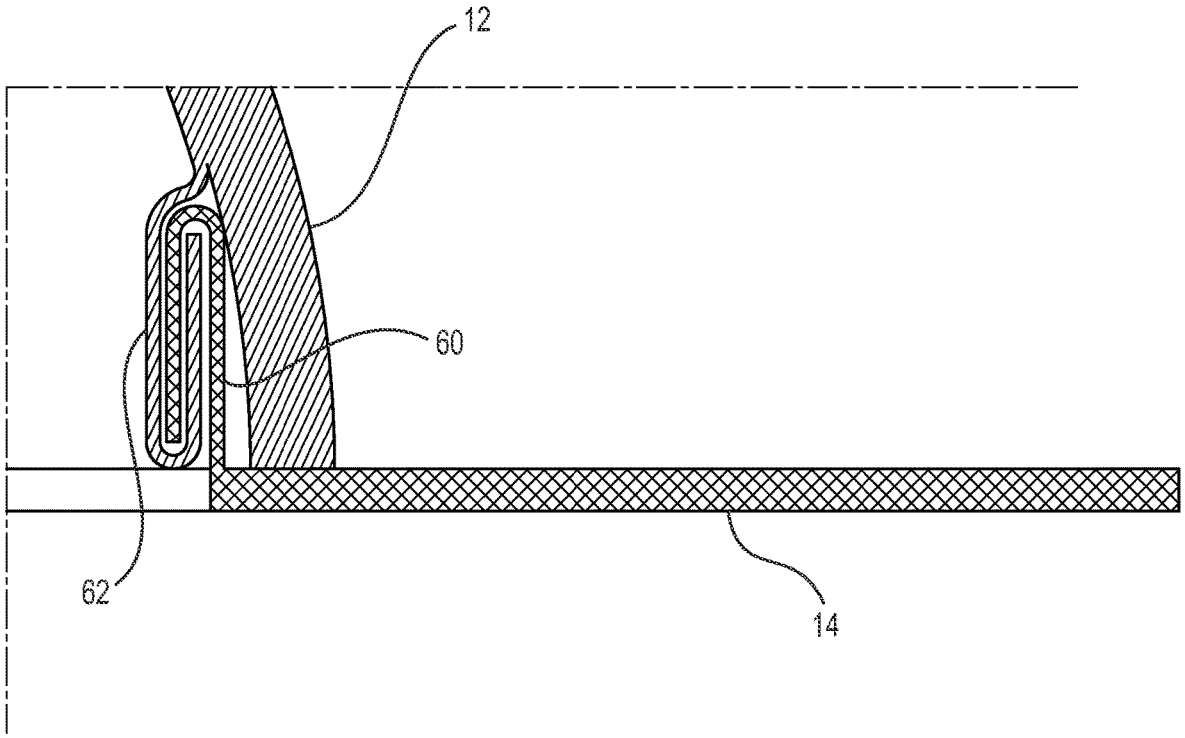
FIG. 10 is a cross-sectional side view of a portion of the baseball cap of FIG. 7, showing interlocking elements of the dome and the brim, according to one embodiment.
Figure 11:
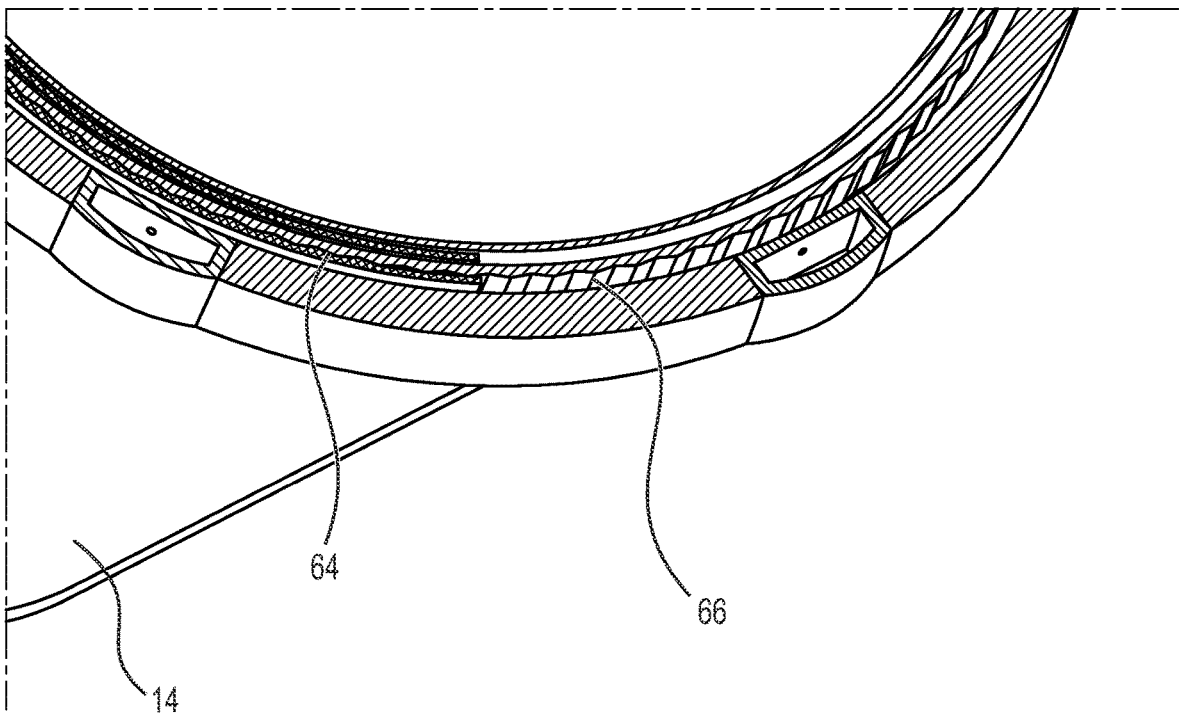
FIG. 11 is cross-sectional perspective view of a portion of the baseball cap of FIG. 7, showing the interlocking elements of the dome and the brim.

FIG. 10 is a cross-sectional side view of a portion of adjustable brim feature of the baseball cap 10. The dome 12 includes a downward-extending fold 62 that is attached to an inner surface of the dome 12 near a bottom edge thereof. As shown in FIG. 10, the upward-extending fold 60 of the brim 14 is configured to engage the downward-extending fold 62 of the dome 12. The folds 60, 62 are interlocked to provide resistive forces to keep the brim 14 attached with the dome 12. Also, the ridges 64, 66 shown in FIG. 9 provide additional resistive forces. However, it should be noted that the folds 60, 62 are interlocked such that the brim 14 can be adjusted with respect to the dome when forces are applied to the respective elements. FIG. 11 is cross-sectional perspective view of a portion of the baseball cap 10. The ridges 64 of the brim 14 are configured to engage with the ridges 66 of the dome 12.

According to some embodiments, the baseball cap 10 may be configured to include the dome 12, which may be placed on a wearer's head. The dome 12 may include one or more panels 16 and the downward-extending fold 62. The baseball cap 10 may further include the brim 14 including the upward-extending fold 60 configured to interlock with the downward-extending fold 62 of the dome 12. The position of the brim 14 may be adjustable with respect to the dome 12 by sliding the upward-extending fold 60 of the brim 14 with respect to the downward-extending fold 62 of the dome 12. Furthermore, the baseball cap 10 may be configured such that an outside surface of the upward-extending fold 60 of the brim 14 may include a plurality of ridges 60 configured to correspond with ridges 62 on an outside surface of the downward-extending fold 62 of the dome 12.

In addition to the brim-adjusting features of the baseball cap 10, the baseball cap 10 may further comprise the hub 20 positioned at a top of the dome 12, wherein the hub may include the central cavity 44 and one or more conduits 46 in gaseous communication with one or more cooling channels 18 of the dome 12. The coolant output port 42, 54 may be configured in gaseous communication with the central cavity 44. The coolant output port 42, 54 may be configured to supply a coolant gas to the one or more cooling channels 18 of the dome 12 via the central cavity 44 of the hub 20.

Figure 12A:
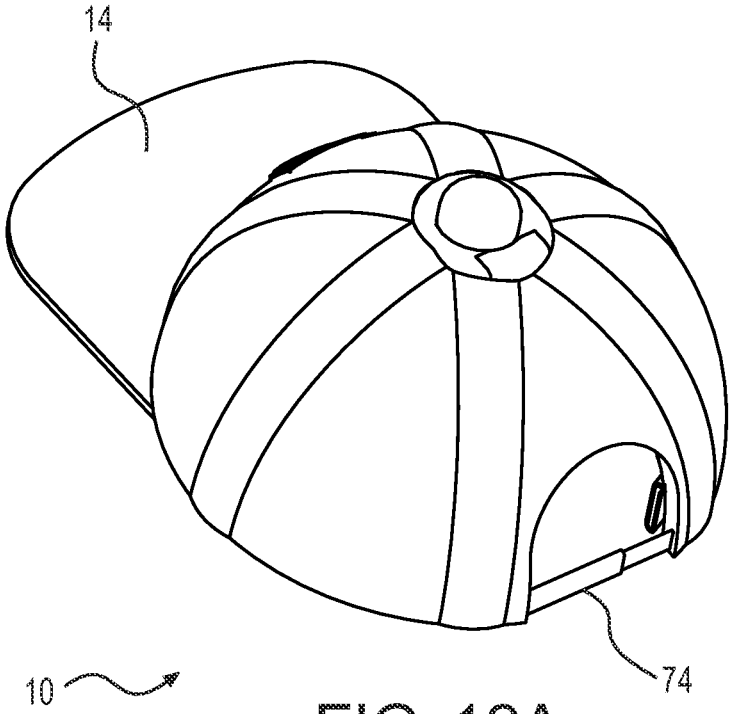
FIG. 12A is a perspective back side view of a baseball cap, such as the baseball caps of FIG. 1 and/or FIG. 7, including a tightening assembly with the baseball cap in a loosened state.
Figure 12B:
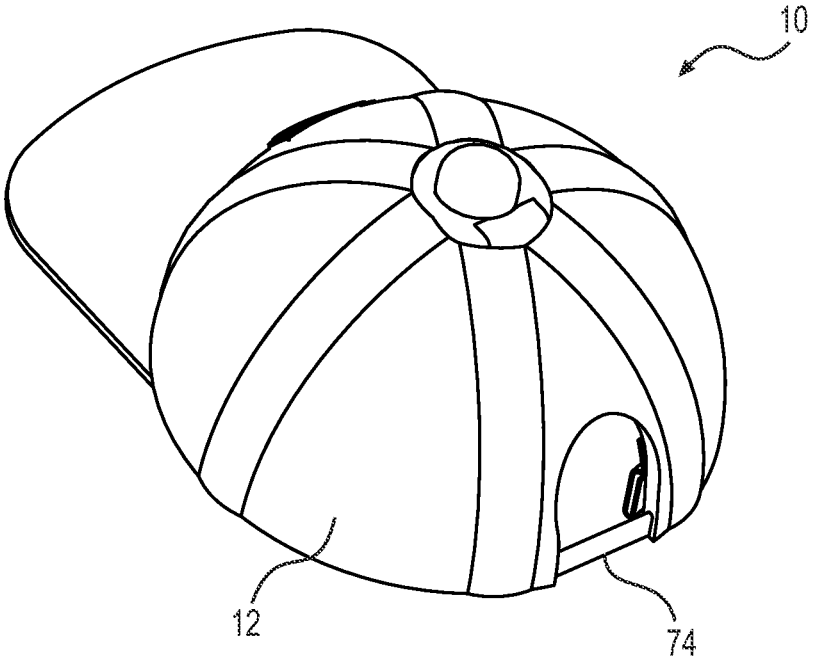
FIG. 12B is a perspective back side view of the baseball cap of FIG. 12A showing the tightening assembly with the baseball cap in a tightened state.

FIG. 12A is a perspective back side view of a baseball cap, such as the baseball caps 10 of FIG. 1 and/or FIG. 7, according to embodiments in which a tightening assembly 74, or strap assembly, is incorporated into the baseball cap 10. FIG. 12A shows the baseball cap 10 in a loosened state. FIG. 12B is a perspective back side view of the baseball cap 10 showing the tightening assembly 74 in a tightened state.

Figure 13:
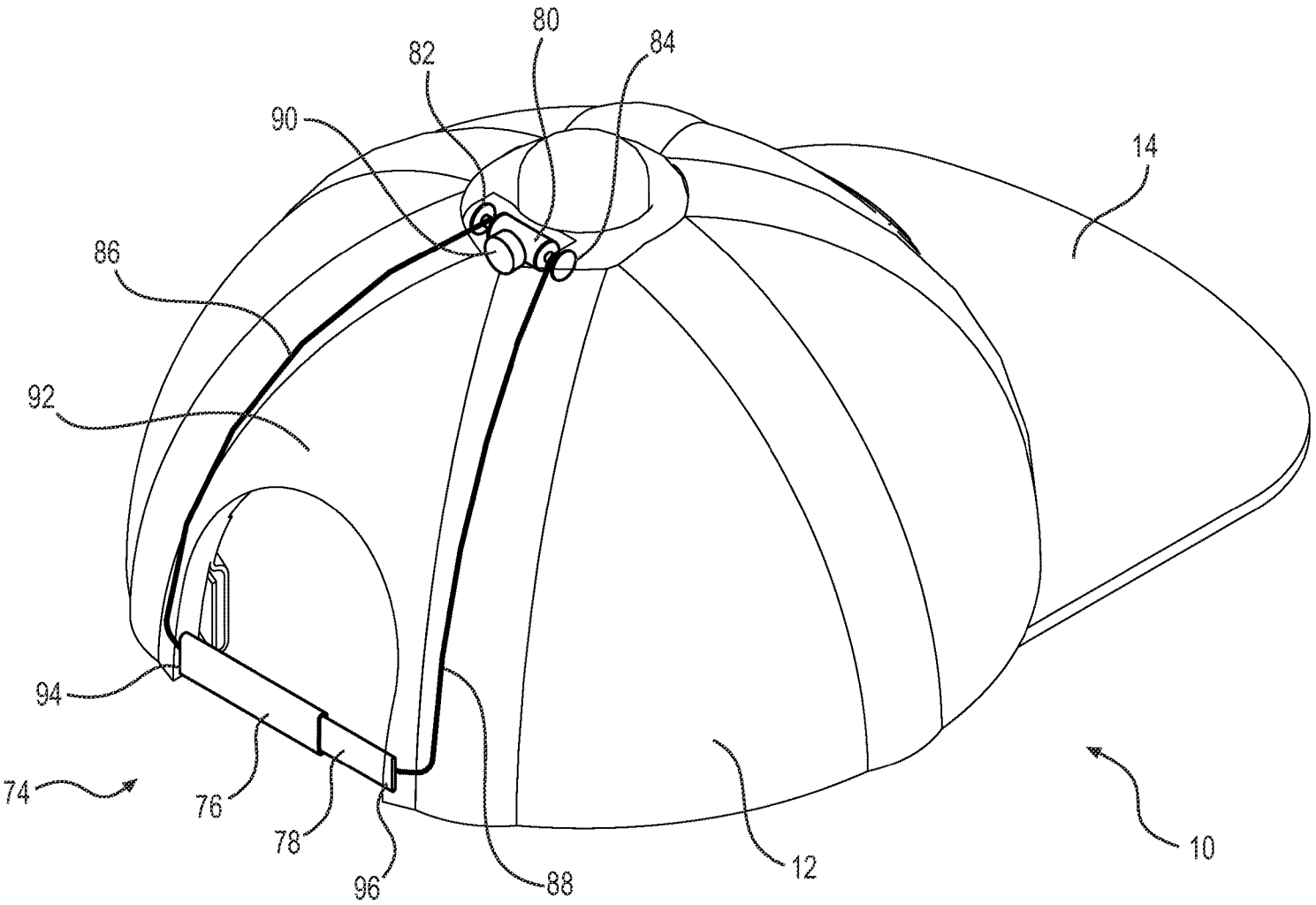
FIG. 13 is a perspective back side view of the baseball cap of FIG. 12A showing details of the tightening assembly, according to one embodiment.

FIG. 13 is a perspective back side view of the baseball cap 10 showing an embodiment of the tightening assembly 74. According to this embodiment, the tightening assembly 74 includes an outer strap 76, an inner strap 78, a motor 80, a first cable pulley 82, a second cable pulley 84, a first cable 86, a second cable 88, and a battery 90. The outer strap 76 and inner strap 78 are configured to join bottom corners of a back panel 92 of the baseball cap 10 in an adjustable manner. The outer strap 76 is connected to a first edge portion 94 at a left side bottom corner of the back panel 92 and the inner strap 78 is connected to a second edge portion 96 at a right side bottom corner of the back panel 92.

Figure 14B:
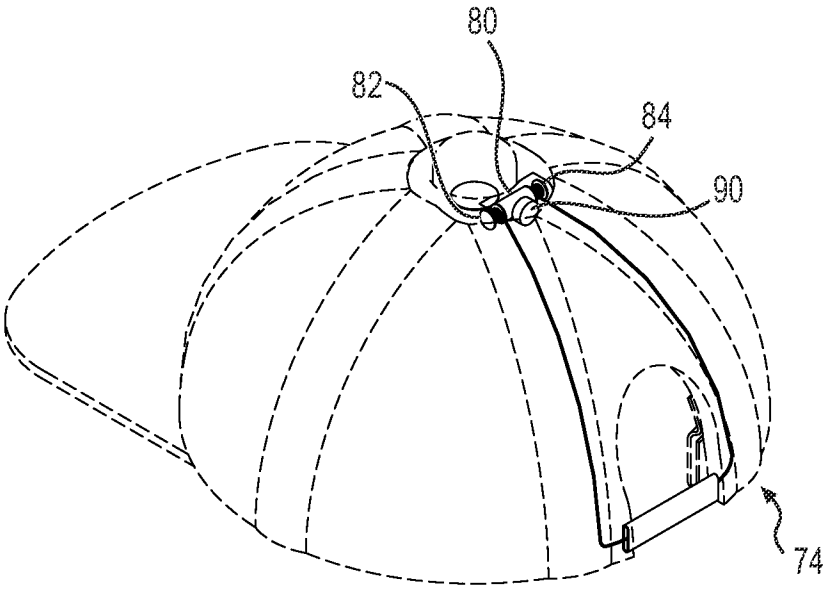
FIG. 14B is a perspective back side view of the baseball cap of FIG. 12A showing the tightening assembly in a tightened state.
Figure 14A:
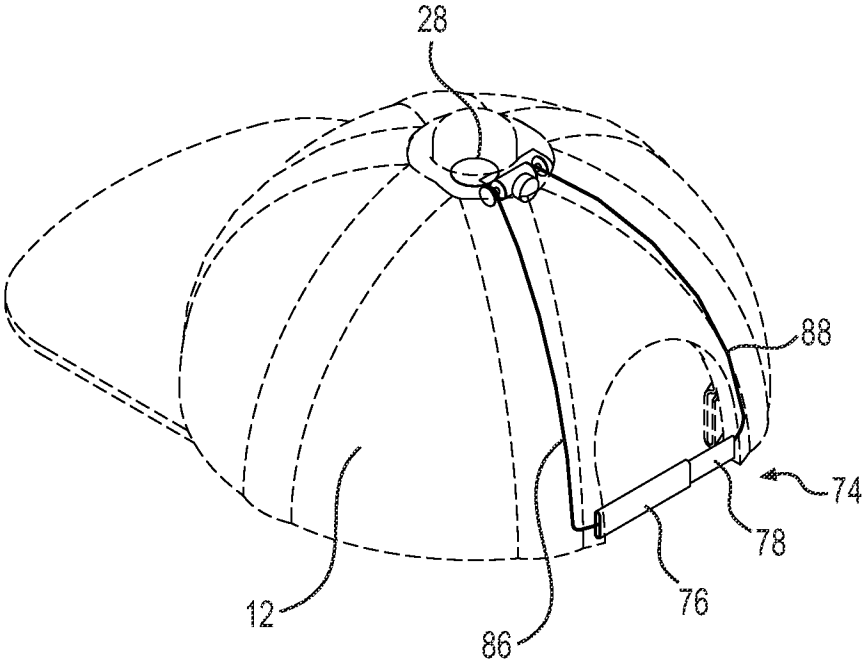
FIG. 14A is a perspective back side view of the baseball cap of FIG. 12A showing the tightening assembly in a loosened state.

FIG. 14A is a perspective back side view of the baseball cap 10 showing the tightening assembly 74 in a loosened state. FIG. 14B is a perspective back side view of the baseball cap of FIG. 12A showing the tightening assembly 74 in a tightened state.

Figure 15:
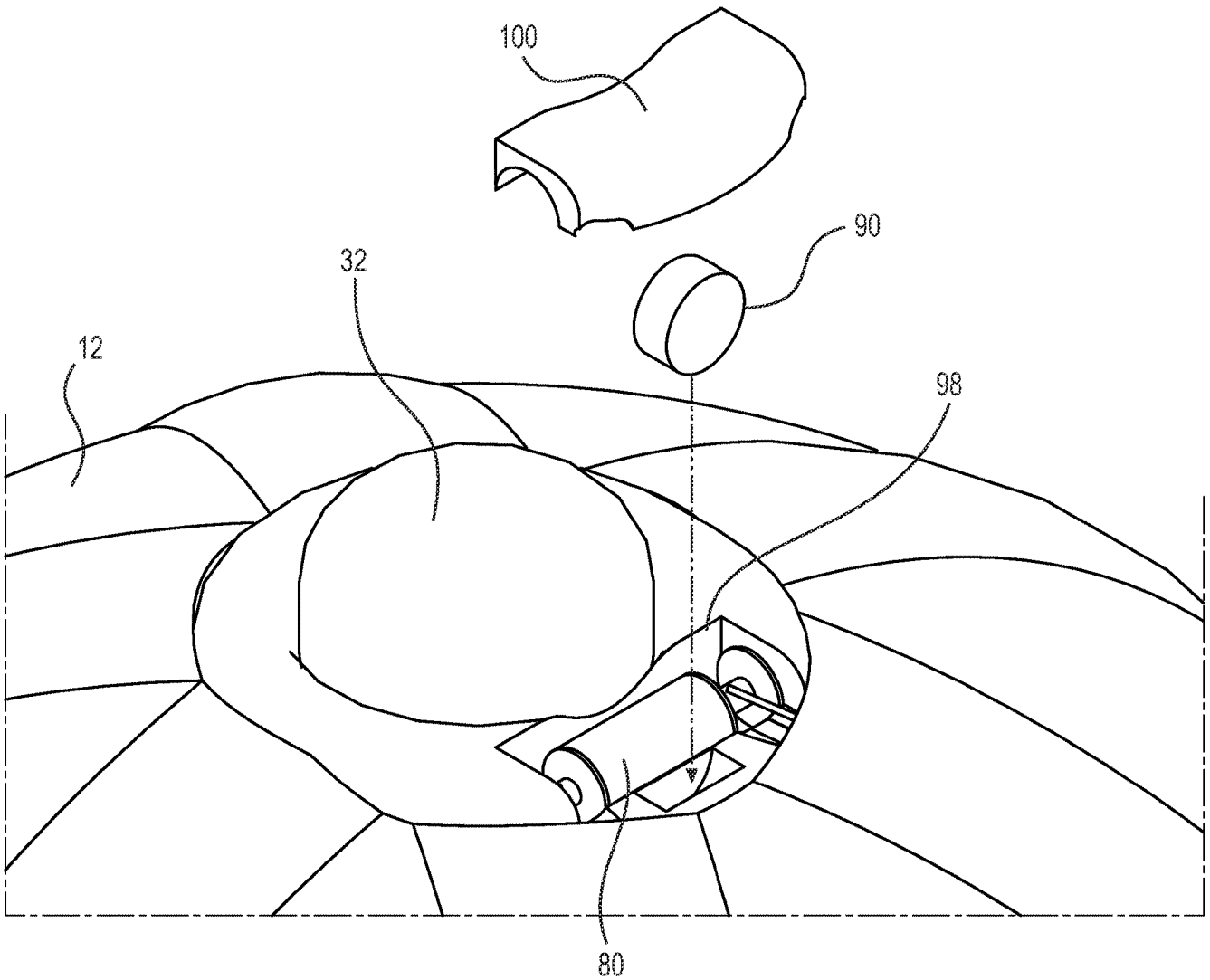
FIG. 15 is perspective view of a top portion of the dome of the baseball cap of FIG. 12A, showing elements of the tightening assembly, according to one embodiment.

FIG. 15 is perspective view of a top portion of the dome 12 of the baseball cap 10, showing elements of the tightening assembly 74. As illustrated, the tightening assembly 74 further includes the motor 80, the battery 90, and a motor compartment 98 that houses the motor 80 and battery 90. The motor compartment 98 can be closed from the environment by a battery cover 100 that is inserted on the hub to protect the internal components of the motor compartment 98.

Figure 16:
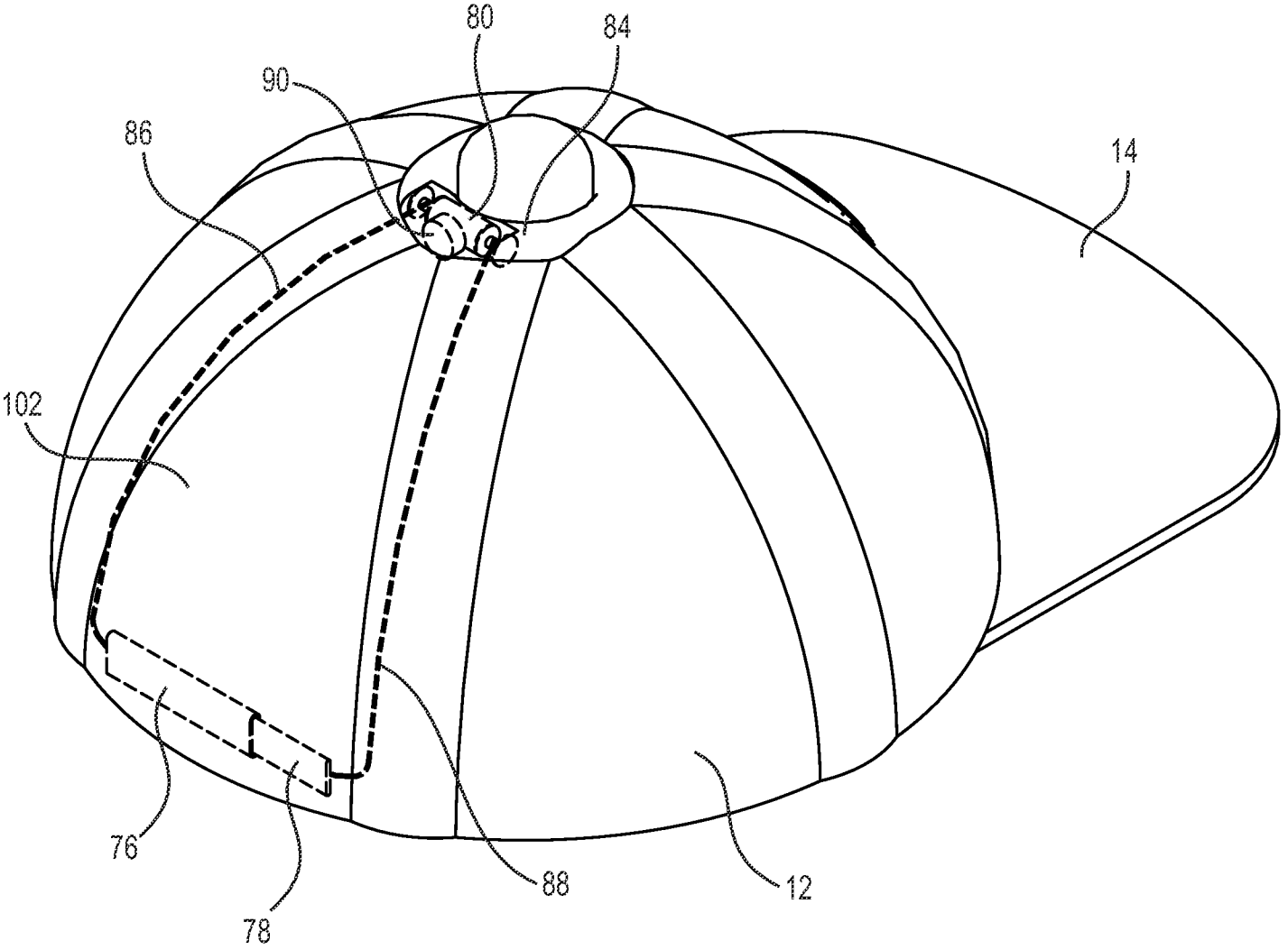
FIG. 16 is a perspective back side view of a baseball cap having a closed back panel and including the tightening assembly shown in FIG. 13, according to one embodiment.

FIG. 16 is a perspective back side view of the baseball cap 10 with the tightening assembly 74, wherein the baseball cap 10 includes a closed back panel 102. The closed back panel is a full panel, similar to the other panels 16 of the cap 10. Unlike the back panel 92 shown in FIGS. 12-14, the closed back panel 102 can be tightened by folding (e.g., in an accordion-style fold) the panel 102 when the outer strap 76 and inner strap 78 are drawn together.

Accordingly, various embodiments of the tightening assembly 74 of the baseball cap 10 may be provided. In one embodiment, the baseball cap 10 may comprise the dome 12 configured to be placed on a wearer's head and the strap assembly 74 configured to adjust a tightness of the dome 12 on the wearer's head. The strap assembly 74 may include the outer strap 76 attached to the first edge portion 94 of the dome 12 and the inner strap 78 attached to the second edge portion 96 of the dome 12. The inner strap 78 may be configured to be movable within the outer strap 76. The motor 80 is attached to the first and second cables 86, 88. The first cable 86 is configured to draw the inner strap 78 closer to the first edge portion 94 of the dome 12 and the second cable 88 is configured to draw the outer strap 76 closer to the second edge portion 96 of the dome 12.

In addition, the tightening assembly 74 may be further defined in that a hub is positioned at a top portion of the dome 12 and the motor 80 is positioned within the hub. The motor 80 may further comprise the first cable pulley 82 attached to the first cable 86 and the second cable pulley 84 attached to the second cable 88.

Furthermore, the baseball cap 10 may further include a proximity sensor 28 (shown in FIGS. 3, 4A, 4B, 5, and 6). The proximity sensor 28 is positioned on a top inside surface of the dome 12 and is configured to detect when the dome 12 is placed on the wearer's head. The motor 80 is configured to tighten the dome 12 on the wearer's head when the proximity sensor 28 detects that the dome 12 has been placed on the wearer's head. When being removed, the proximity sensor 28 may no longer detect the wearer's head in close proximity and can then cause the tightening assembly 74 to reverse the tightening actions to thereby loosen the cap 10, allowing the cap 10 to be removed more easily from the wearer's head.

Figure 17:
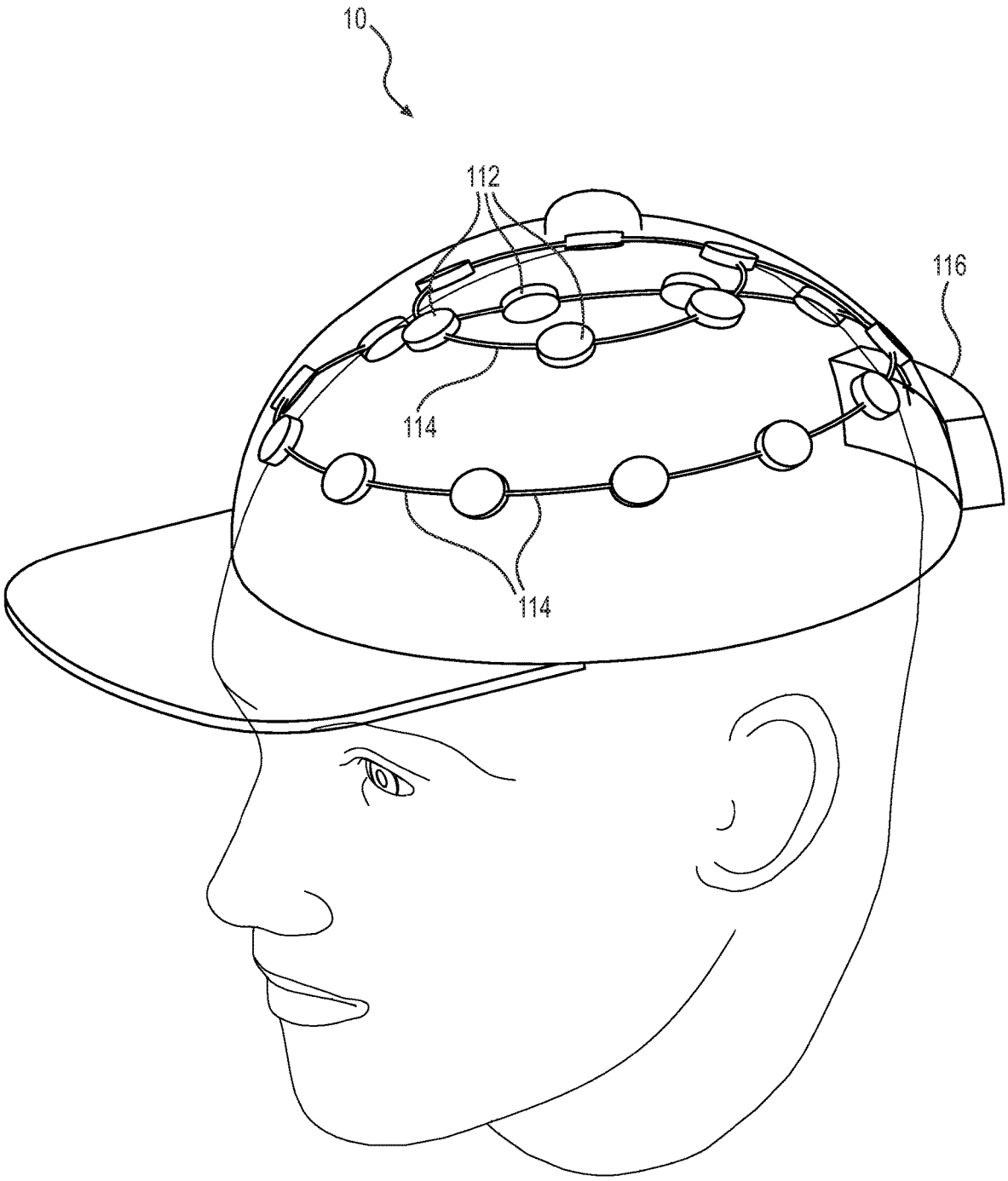
FIG. 17 is a perspective front side view of a baseball cap, such as the baseball cap of FIGS. 1, 7, and/or 12, having an electroencephalography (EEG) system, according to some embodiments of the present disclosure.

FIG. 17 is a perspective front side view of a baseball cap, such as the baseball cap 10 of FIGS. 1, 7, and/or 12, further comprising an electroencephalography (EEG) system, according to some embodiments of the present disclosure. The EEG system 110 includes a plurality of brainwave sensors 112 connected in a daisy-chain arrangement by sensor wires 114, acting as sensor conduits. A control box 116 may include a power supply and one or more processors (e.g., microprocessor, CPU, etc.). The processors of the control box 116 may be configured to receive brainwave signals from the various brainwave sensors 112 attached on an inside surface of the dome 12. The brainwave sensors 112 may be positioned at particular locations that correspond with certain areas of the wearer's brain to detect particular brainwaves. The control box 116 is configured to determine the intensity and other factors of the brainwaves at the particular locations to detect the brain activity of the wearer.

The control box 116 may be configured to determine specific conditions of the wearer. For example, if the brainwave activity of the wearer is detected as an indication that the wearer may be losing consciousness, the control box 116 may sound an alarm. This may be beneficial if the wearer is driving a vehicle and may be falling asleep at the wheel or if the wearer is working in the heat and may be exposed to too much heat. Another example may be the detection of brainwave activity of a wearer who may be losing focus on a task. This may be an indication that the wearer needs to take a break from their current activities.

Thus, according to another embodiment, the baseball cap 10 may comprise the dome 12 and the plurality of brainwave sensors 112 positioned on an inside surface of the dome 12 such that the brainwave sensors 112 are configured to contact a wearer's head when the baseball cap 10 is placed on the wearer's head. The brainwave sensors 112 may be configured to be receptive to brainwave activity of the wearer. The control box 116 is configured in electrical communication with the plurality of brainwave sensors 112.

Also, the baseball cap 10 shown in FIG. 17 may further be configured such that the control box 116 comprises a power supply and a wireless transmission device. The wireless transmission device may be configured to transmit information related to the brainwave activity to a remote receiver.

What is claimed is:

1. A baseball cap comprising:

a dome configured to be placed on a wearer's head;

a strap assembly configured to adjust a tightness of the dome on the wearer's head, the strap assembly including an outer strap attached to a first edge portion of the dome and an inner strap attached to a second edge portion of the dome, the inner strap configured to be movable within the outer strap; and a motor attached to first and second cables, the first cable configured to draw the inner strap closer to the first edge portion of the dome and the second cable configured to draw the outer strap closer to the second edge portion of the dome.

2. The baseball cap of claim 1, further comprising a hub positioned at a top portion of the dome, wherein the motor is positioned with the hub.

3. The baseball cap of claim 1, wherein the motor further comprises a first cable pulley attached to the first cable and a second cable pulley attached to the second cable.

4. The baseball cap of claim 1, further comprising a proximity sensor positioned on a top inside surface of the dome and configured to detect when the dome is placed on the wearer's head, wherein the motor is configured to tighten the dome on the wearer's head when the proximity sensor detects that the dome has been placed on the wearer's head.

5. The baseball cap of claim 1, further comprising:

a hub positioned at a top of the dome, the hub comprising a central cavity and one or more conduits in gaseous communication with one or more cooling channels of the dome; and a coolant output port in gaseous communication with the central cavity;

wherein the coolant output port is configured to supply a coolant gas to the one or more cooling channels of the dome via the central cavity of the hub.

6. The baseball cap of claim 1, wherein an outside surface of the upward-extending fold of the brim includes a plurality of ridges configured to correspond with ridges on an outside surface of the downward-extending fold of the dome.

7. The baseball cap of claim 1, further comprising a plurality of brainwave sensors positioned on an inside surface of the dome such that the brainwave sensors are configured to contact the wearer's head when the baseball cap is placed on the wearer's head, the brainwave sensors configured to be receptive to brainwave activity of the wearer.

8. The baseball cap of claim 7, wherein the control box further comprises a power supply and a wireless transmission device, the wireless transmission device configured to transmit information related to the brainwave activity to a remote receiver.

9. The baseball cap of claim 1, further comprising:

a dome configured to be placed on a wearer's head, the dome including one or more panels and a downward-extending fold;

a brim including an upward-extending fold configured to interlock with the downward-extending fold of the dome;

wherein the position of the brim is adjustable with respect to the dome by sliding the upward-extending fold of the brim with respect to the downward-extending fold of the dome.

10. The baseball cap of claim 1, further comprising:

a hub positioned at a top of the dome, the hub comprising a central cavity and one or more conduits in gaseous communication with the one or more cooling channels of the dome; and a coolant output port in gaseous communication with the central cavity;

wherein the dome including one or more panels and one or more cooling channels;

wherein the coolant output port is configured to supply a coolant gas to the one or more cooling channels of the dome via the central cavity of the hub.

11. The baseball cap of claim 10, wherein each of the one or more cooling channels includes one or more bleeder holes directed toward an inside of the dome.

12. The baseball cap of claim 10, wherein the dome includes six panels alternately positioned with respect to six cooling channels.

13. The baseball cap of claim 10, further comprising a coolant container including a coolant reservoir configured to store the coolant gas, a valve, and the coolant output port.

14. The baseball cap of claim 13, wherein the valve is configured to separate an interior space of the coolant reservoir from the coolant output port during a non-cooling state and configured to allow coolant to escape from the coolant reservoir through the coolant output port during a cooling state.

15. The baseball cap of claim 14, wherein:

the valve of the coolant container extends downward from a stem attached to an inside top surface of the coolant reservoir and covers the coolant output port during the non-cooling state, and when a force is applied to an outside of the coolant container, the stem is tilted with respect to the coolant output port causing the valve to release coolant from the coolant reservoir through the coolant output port.

16. The baseball cap of claim 15, wherein the hub is configured to hold the coolant container such that the coolant output port of the coolant container is adjacent to the central cavity of the hub.

17. The baseball cap of claim 15, wherein the hub comprises stand-offs formed on a bottom surface of the central cavity for creating channels between the coolant output port and the one or more conduits when the coolant container is positioned in the hub.

18. The baseball cap of claim 15, wherein the hub comprises a reduced diameter portion configured to apply a compression force on exterior side walls of the coolant container to keep the coolant container in a fixed position with respect to the hub.

19. The baseball cap of claim 1, further comprising an injection insert including an inflation valve and the coolant output port, wherein the coolant gas is supplied by an external source through a needle inserted in the inflation valve.

20. A baseball cap comprising:

a dome configured to be placed on a wearer's head;

a strap assembly configured to adjust a tightness of the dome on the wearer's head, the strap assembly including an outer strap attached to a first edge portion of the dome and an inner strap attached to a second edge portion of the dome, the inner strap configured to be movable within the outer strap; and wherein the first cable is configured to draw the inner strap closer to the first edge portion of the dome and the second cable is configured to draw the outer strap closer to the second edge portion of the dome.

* * * * *